US007673961B2

(12) United States Patent
Shihoh et al.

(10) Patent No.: US 7,673,961 B2
(45) Date of Patent: Mar. 9, 2010

(54) INSPECTION METHOD FOR A RECORDING HEAD, INSPECTION APPARATUS FOR A RECORDING HEAD, AND RECORDING APPARATUS

(75) Inventors: Makoto Shihoh, Yokohama (JP); Takatsuna Aoki, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 369 days.

(21) Appl. No.: 11/737,953

(22) Filed: Apr. 20, 2007

(65) Prior Publication Data

US 2007/0291069 A1 Dec. 20, 2007

(30) Foreign Application Priority Data

Jun. 14, 2006 (JP) ..... 2006-164710

(51) Int. Cl.
*B41J 29/393* (2006.01)

(52) U.S. Cl. ..... 347/19; 347/14; 347/17

(58) Field of Classification Search ..... 347/5, 347/9, 14, 17, 19
See application file for complete search history.

(56) References Cited

U.S. PATENT DOCUMENTS 6,056,387 A 5/2000 Kaneko
6,634,731 B2 * 10/2003 Kao et al. ..... 347/14
6,644,774 B1 * 11/2003 Burger et al. ..... 347/19

FOREIGN PATENT DOCUMENTS

JP 07-246708 A 9/1995
JP 11-179934 A 7/1999

* cited by examiner

*Primary Examiner*—Lam S Nguyen
(74) *Attorney, Agent, or Firm*—Canon U.S.A., Inc. I.P. Division

(57) ABSTRACT

A method is provided for inspecting a recording head including a plurality of electrothermal conversion elements and a temperature detection element placed above or below each of the plurality of electrothermal conversion elements. The method includes driving the electrothermal conversion element, determining whether there is a change in slope of a temperature fall process in temperature detected by the temperature detection element during a predetermined time, if it is determined that there is a change in slope of the temperature fall process, obtaining a timing of the change in slope, and determining whether ink is discharged normally based on the obtained timing of the change in slope and a predetermined timing of a change in slope of the temperature fall process.

6 Claims, 9 Drawing Sheets

INSPECTION METHOD FOR A RECORDING HEAD, INSPECTION APPARATUS FOR A RECORDING HEAD, AND RECORDING APPARATUS

BACKGROUND OF THE INVENTION

1. Field of the Invention

The present invention relates to a discharge inspection method for a recording head in which recording ink is discharged from a nozzle by an electrothermal energy conversion element applying heat energy on the ink. In addition, the present invention relates to a discharge inspection apparatus for a recording head and a recording apparatus.

2. Description of the Related Art

An inkjet recording apparatus is configured to discharge ink (or an ink droplet for recording) from a nozzle arranged on a recording head. The discharged ink adheres to a recording material, such as a paper sheet, to record various information on the recording material.

An inkjet recording apparatus forms an image by discharging ink from a minute nozzle directly onto a recording material. Therefore, a defective discharge may occur when ink is attached to the surface of a recording head on which the nozzle is arranged (hereinafter referred to as a nozzle surface). For example, when a discharged ink hits a recording material, a part of the discharged ink can bounce off without adhering to the recording material. Moreover, minute ink droplets other than main ink droplets used for recording onto the recording material can be discharged and float in the atmosphere. Accumulation of such ink on the nozzle surface may cause a defective discharge. To prevent such accumulation, the nozzle surface can be treated with a liquid repellant. However, ink residue is difficult to remove completely.

In particular, a defective discharge such as described above tends to occur in a full-line recording apparatus. The full-line recording apparatus includes a plurality of nozzles arranged linearly corresponding to the width of a recording material and can perform recording at high speed. In such an apparatus, a discharge nozzle in which a defective discharge has occurred is quickly identified to conduct recovery of the recording head or to complement image recording.

In an inkjet recording apparatus discussed in Japanese Patent Application Laid-Open No. 07-246708, an optical sensor measures the reflected light intensity of a discharge port surface of a recording head to detect wetness of the discharge port surface. A cleaning unit cleans the discharge port surface according to an output of the optical sensor.

Furthermore, Japanese Patent Application Laid-Open No. 11-179934 discusses an ink jet printing apparatus which is configured to detect dust attached to the bottom surface of a recording head.

In the inkjet recording apparatus discussed in Japanese Patent Application No. 07-246708, the optical sensor can produce an output corresponding to the area of attached ink since wetness is detected with reflected light. However, a small amount of attached ink or an accurate position of the attached ink is difficult to detect.

Moreover, in the ink jet printing apparatus discussed in Japanese Patent Application Laid-Open No. 11-179934, an accurate position of ink attached to the nozzle surface cannot be specified. More specifically, attached ink is detected based on whether a detection light beam is blocked. Consequently, an accurate position of the attached ink in the light path cannot be determined. Therefore, it cannot be determined whether the detected attached ink will clog the head nozzle to generate an ink non-discharge or is located in an area having no nozzle arranged and will not affect the discharge. As a result, each time attached ink is detected on the nozzle surface, a head recovery process such as wiping is always performed. Such process stops printing unnecessarily and degrades throughput performance.

Furthermore, in the ink jet printing apparatus discussed in Japanese Patent Application Laid-Open No. 11-179934, the light path of a light beam is disposed as close to the nozzle surface as possible in order to detect even a small amount of attached ink. Consequently, any convexity which blocks the light beam cannot be formed on the nozzle surface.

Generally, a sealing material seals a joint which electrically joins a head substrate and a wiring material, such as a flexible circuit board. Such a sealing material protrudes 100 to 300 μm from the nozzle surface and is difficult to eliminate at present.

SUMMARY OF THE INVENTION

The present invention is directed to an inspection method for quickly detecting an ink non-discharge caused by ink attached to a nozzle surface of a recording head.

According to an aspect of the present invention, a method is provided for inspecting a recording head including a plurality of electrothermal conversion elements and a temperature detection element disposed above or below each of the plurality of electrothermal conversion elements. The method includes driving the electrothermal conversion element, determining whether there is a change in slope of a temperature fall process in temperature detected by the temperature detection element during a predetermined time, if it is determined that there is a change in slope of the temperature fall process, obtaining a timing of the change in slope, and determining whether ink is discharged normally based on the obtained timing of the change in slope and a predetermined timing of a change in slope of the temperature fall process.

According to another aspect of the present invention, an apparatus is provided for inspecting a recording head including a plurality of electrothermal conversion elements and a temperature detection element disposed above or below each of the plurality of electrothermal conversion elements. The apparatus includes a driving unit configured to drive the electrothermal conversion element, a first determination unit configured to determine whether there is a change in slope of a temperature fall process in temperature detected by the temperature detection element during a predetermined time, an obtaining unit configured to, if it is determined that there is a change in slope of the temperature fall process, obtain a timing of the change in slope, and a second determination unit configured to determine whether ink is discharged normally based on the timing of the change in slope obtained by the obtaining unit and a predetermined timing of a change in slope of the temperature fall process.

According to yet another aspect of the present invention, a recording apparatus is provided which includes a recording head including a plurality of electrothermal conversion elements and a temperature detection element disposed above or below each of the plurality of electrothermal conversion elements. Here the apparatus includes a driving unit configured to drive the electrothermal conversion element, a first determination unit configured to determine whether there is a change in slope of a temperature fall process in temperature detected by the temperature detection element during a predetermined time, an obtaining unit configured to, if it is determined that there is a change in slope of the temperature fall process, obtain a timing of the change in slope, and a second determination unit configured to determine whether ink is discharged normally based on the timing of the change in slope obtained by the obtaining unit and a predetermined timing of a change in slope of the temperature fall process.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DETAILED DESCRIPTION OF THE EMBODIMENTS

Various exemplary embodiments, features, and aspects of the invention will be described in detail below with reference to the drawings.

First, an example configuration of an inkjet recording apparatus which will be commonly used in a plurality of exemplary embodiments to be described below is described.

Figure 4:
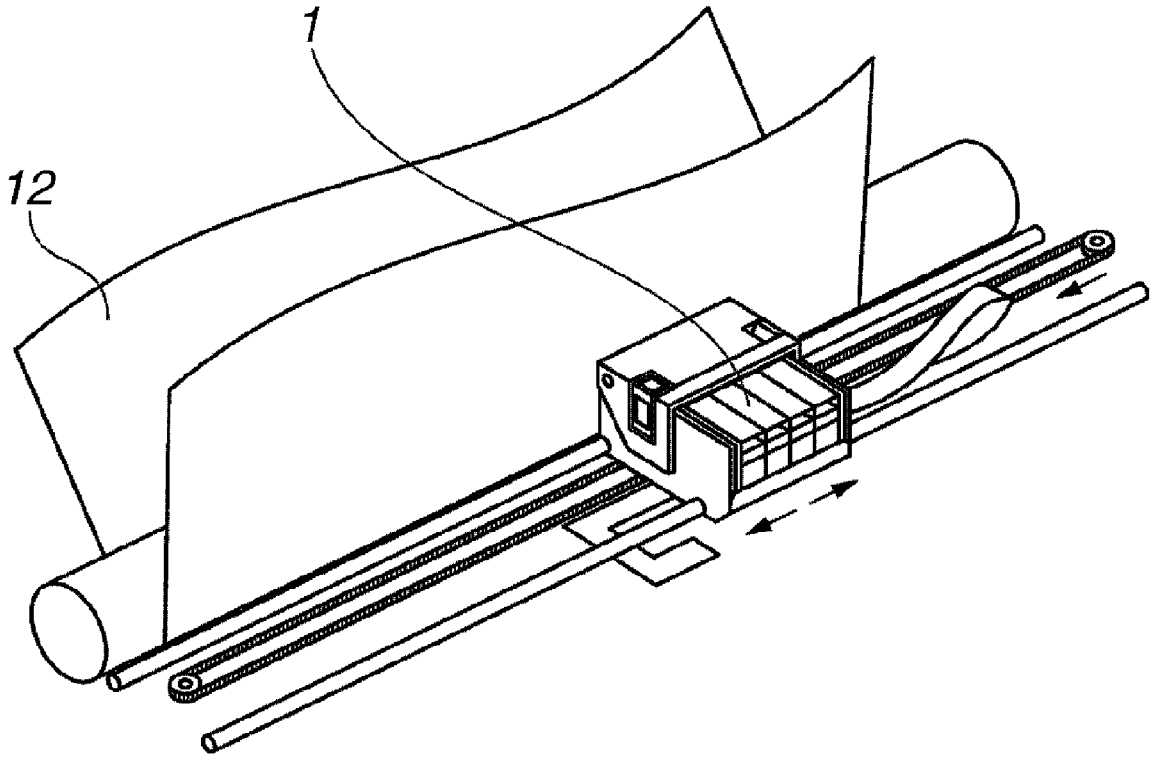
FIG. 4 is a perspective view of an example recording apparatus according to an exemplary embodiment of the present invention.

FIG. 4 illustrates a serial-type inkjet printer according to an exemplary embodiment of the present invention. A recording head 1 includes a plurality of nozzle arrays. The recording head 1 discharges ink droplets from the plurality of nozzle arrays to record an image formed of dots on a recording medium 12.

Figure 7A:
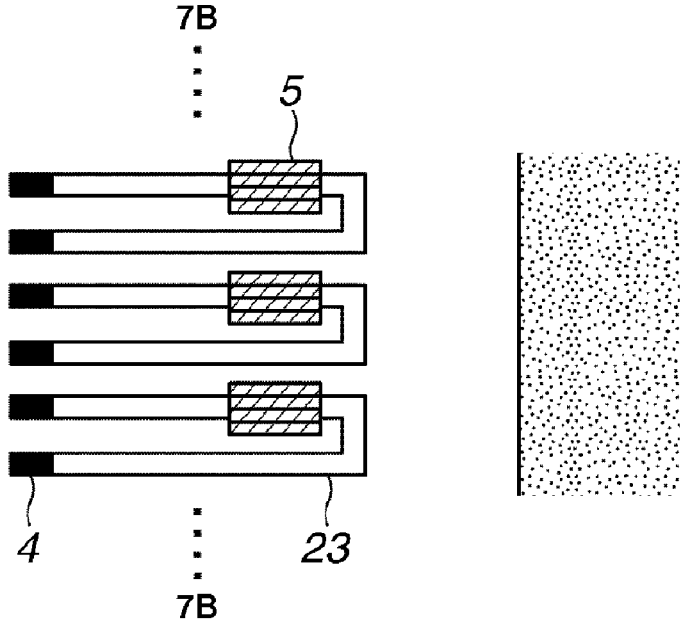
FIGS. 7A and 7B are a plain view and a cross-sectional views of an example recording head, respectively, according to an exemplary embodiment of the present invention.
Figure 7B:
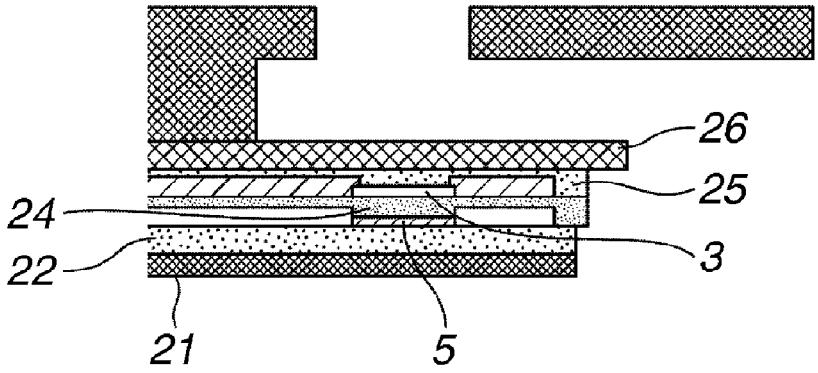

FIGS. 7A and 7B are a plane view and a cross-sectional view of a substrate of an inkjet recording head, respectively, according to an exemplary embodiment.

An electrothermal energy conversion element (hereinafter referred to as a discharge heater) 3 is disposed on a heater board with respect to each nozzle. The discharge heater 3 receives an applied voltage and generates thermal energy to discharge ink droplets from a plurality of nozzles arranged in a line. A discharge heater array composed of a plurality of discharge heaters 3 arranged in a line is disposed on the heater board. A dummy resistor (not shown) which does not discharge ink droplets is disposed in the vicinity of the discharge heater array.

In FIG. 7A, a terminal 4 connects to the outside with a wire bonding. A temperature detection element (hereinafter referred to as temperature sensor) 5 is formed on the heater board with the same film formation process as in the discharge heater 3.

FIG. 7B is a partial cross-sectional view of FIG. 7A taken along line 7B-7B. The temperature sensor 5 is formed on a silicon (Si) substrate 21 via a heat accumulation layer 22 such as a thermally-oxidized film $SiO_2$. The temperature sensor 5 is made from a thin film resistor, such as Al, Pt, Ti, TiN, TiSi, Ta, TaN, and TaSiN, whose resistance changes according to temperature. The thin film resistor further includes TaCr, Cr, CrSi, CrSiN, W, WSi2, WN, Poly-Si, α-Si, Mo, MoSi, Nb, and Ru. Furthermore, a discrete wiring 23 such as Al used for joint wiring is formed on the Si substrate 21. Moreover, an Al wiring which connects the discharge heater 3 and a control circuit formed on the Si substrate 21 is formed on the Si substrate 21. In addition, the discharge heater 3, a passivation film 25 such as SiN, and an cavitation-resistant film 26 are laid on one another very densely with a semiconductor process and formed on the Si substrate 21 via an interlayer insulating film 24.

An example of the cavitation-resistant film 26 is Ta, which increases the cavitation resistance effect on the discharge heater 3.

The temperature sensor 5, formed as a thin film resistor, is disposed directly beneath each of the discharge heaters 3 separately and independently. The discrete wiring 23 connected to each temperature sensor 5 constitutes a part of a detection circuit which detects information on the temperature sensor 5.

According to the present exemplary embodiment, the heat accumulation layer 22 such as a thermally-oxidized film $SiO_2$ is formed on the Si substrate 21. The Al wiring which connects the discharge heater 3 and the control circuit formed on the Si substrate 21 is formed on the Si substrate 21 via the heat accumulation layer 22. In addition, the discharge heater 3, the passivation film 25 such as SiN, and the cavitation-resistant film 26 such as Ta are formed on a conventional heat accumulation layer 22 via the interlayer insulating film 24. The cavitation-resistant film 26 is formed to increase the cavitation resistance effect on the discharge heater 3. The temperature sensor 5 formed with a thin film resistor such as Al, Pt, and Ti, and the discrete wiring 23 such as Al for joint wiring are filmed and patterned on the heat accumulation layer 22. As a result, a recording head can be formed without changing the conventional recording head structure and is advantageous in manufacturing.

In the present exemplary embodiment, the temperature sensor 5 is square-shaped. However, the temperature sensor 5 can take a meandering shape to realize high resistance. Such a temperature sensor can output a high voltage value even when the temperature change is very small.

Figure 5:
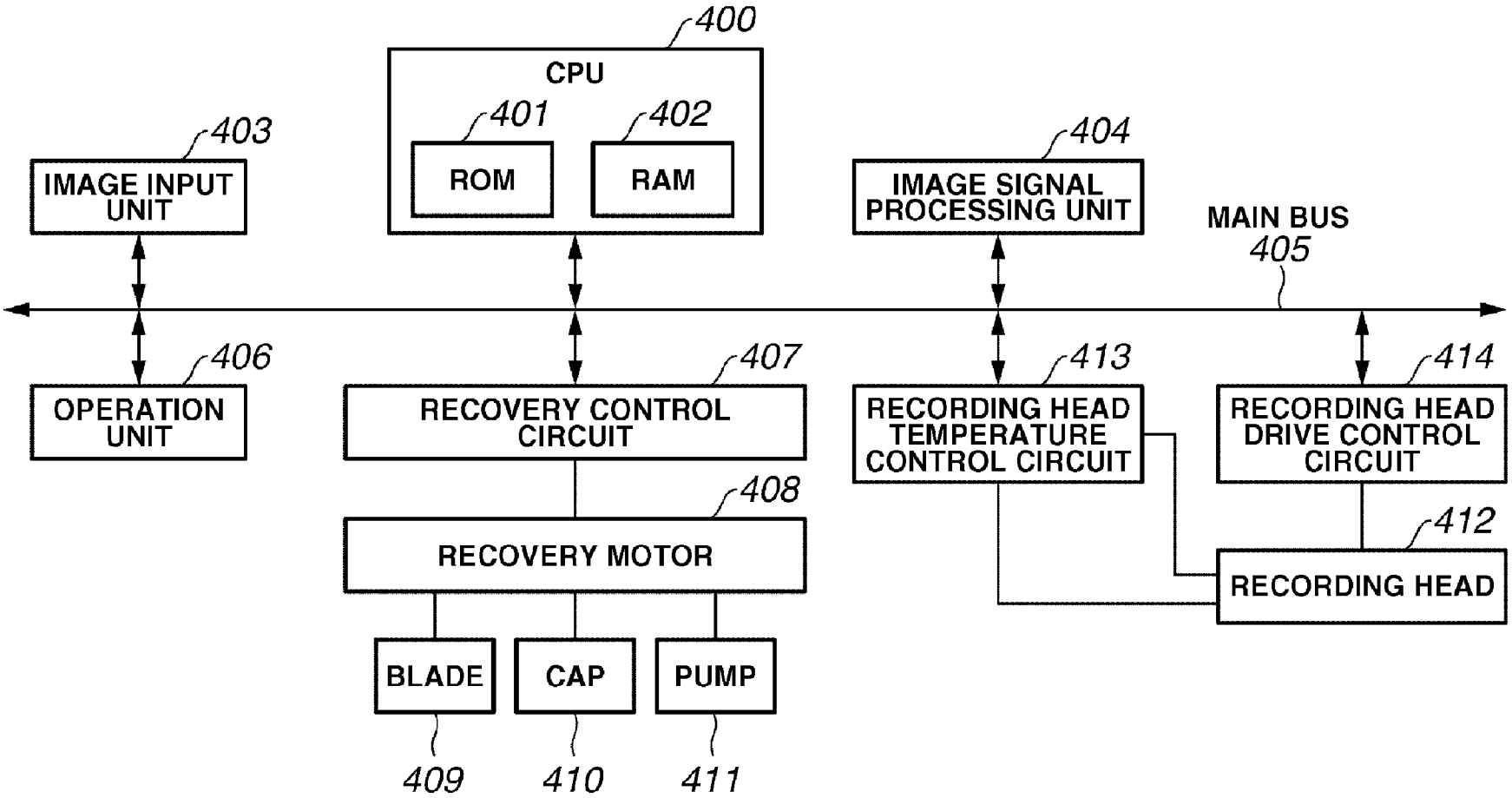
FIG. 5 illustrates an example control circuit of a recording apparatus according to an exemplary embodiment of the present invention.

FIG. 5 illustrates a control circuit of a recording apparatus according to an exemplary embodiment of the present invention. The control circuit includes a circuit group which functions by executing software and a circuit group which executes mechanical operations. The circuit group which functions by executing software includes an image input unit 403, an image signal processing unit 404 corresponding to the image input unit 403, and a central processing unit (CPU) 400. The circuit group which executes mechanical operations includes an operation unit 406, a recovery control circuit 407, a recording head temperature control circuit 413, and a recording head drive control circuit 414. Each of these units accesses a main bus 405.

The CPU 400 includes a read-only memory (ROM) 401 and a random access memory (RAM) 402. The CPU 400 controls recording by providing an appropriate recording condition to input information and driving a recording head 412. The ROM 401 previously stores a program for performing discharge inspection and a program for executing a recovery procedure of the recording head 412. The RAM 402 stores, for example, temperature information or calculation results (such as first-order differentiation or second-order differentiation), to be described later.

The recovery control circuit 407 controls a recovery motor 408. The recovery motor 408 drives the recording head 412, a cleaning blade 409, a cap 410, and a suction pump 411, which oppose the recording head 412.

The recording head drive control circuit 414 drives the discharge heaters 3 of the recording head 412 according to the driving condition provided by the CPU 400. The recording head drive control circuit 414 also drives the recording head 412 to perform auxiliary discharge, recording, and inspection.

The CPU 400 further includes a timer unit. The CPU 400 can search and determine the temperature change using the timer unit and information stored in the RAM 402.

Figure 6A:
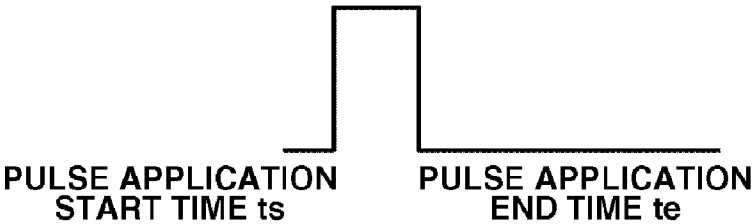
FIGS. 6A, 6B, and 6C illustrate example temperature profiles obtained when ink is discharged normally according to an exemplary embodiment of the present invention.
Figure 6B:
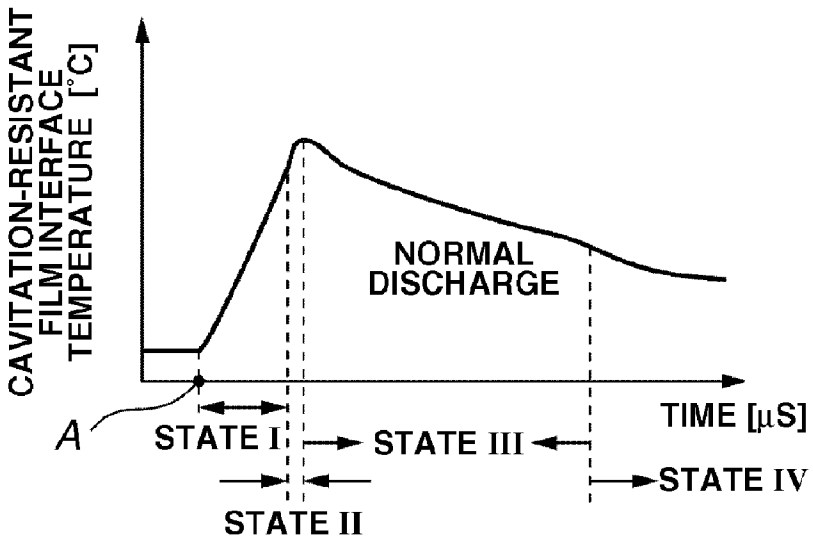
Figure 6C:
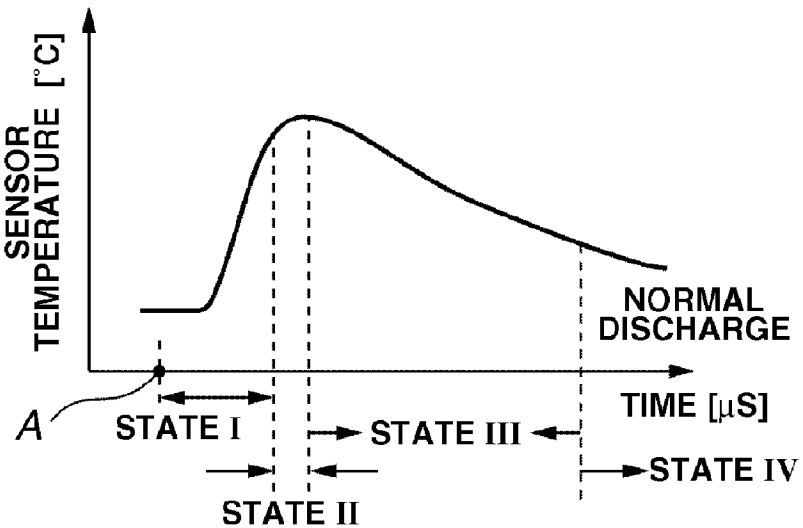

FIG. 6A illustrates a signal waveform for driving the discharge heater 3. In FIG. 6A, the signal waveform includes start time ts and end time te. FIG. 6B illustrates a temperature profile of the ink-cavitation-resistant film interface when ink is discharged normally. FIG. 6C illustrates a temperature profile detected by the temperature sensor 5. The timing A in FIGS. 6B and 6C corresponds to the start time for applying a driving pulse to the discharge heater 3, i.e., the time ts in FIG. 6A.

Referring to FIG. 6B, the temperature of the discharge heater 3 rises rapidly in response to the applied driving pulse. Accordingly, after a short time lag, the temperature of the ink-cavitation-resistant film interface also rises (state I). When the temperature of the ink-cavitation-resistant film interface reaches the foaming temperature of ink, a bubble is generated and grows. When a bubble is generated, the cavitation-resistant film 26 and ink do not contact each other. The heat conductivity of a bubble ($\lambda$gas) is one-digit smaller compared to the heat conductivity of ink ($\lambda$liquid). Therefore, when a bubble intervenes between ink and the cavitation-resistant film 26, almost all of the heat generated in the discharge heater 3 is accumulated in the heater board.

As a result, the temperature of the ink-cavitation-resistant film interface rises rapidly. After that, the temperature of the discharge heater 3 stops rising when the pulse application stops. Accordingly, the temperature of the ink-cavitation-resistant film interface also stops rising (state II). After that, the temperature of each of the discharge heater 3 and the ink-cavitation-resistant film interface falls (state III). After a certain period of time, the bubble shrinks, and the cavitation-resistant film 26 and the ink come into contact again. The ink-cavitation-resistant film interface is cooled down at a much faster rate and returns to the initial state (state IV).

Since the interlayer insulating film 24 is formed between the discharge heater 3 and the temperature sensor 5, heat conduction from the discharge heater 3 takes time. Therefore, as illustrated in FIGS. 6B and 6C, the manner of a change in temperature after the driving pulse is applied is different between the ink-cavitation-resistant film interface and the temperature sensor 5. The temperature sensor 5 is formed just below the discharge heater 3 via the interlayer insulating film 24 so that the temperature inside the nozzle can be detected accurately at high speed or in a short time.

The detection of an ink non-discharge of a recording head in the inkjet recording apparatus will be described below.

Figure 1:
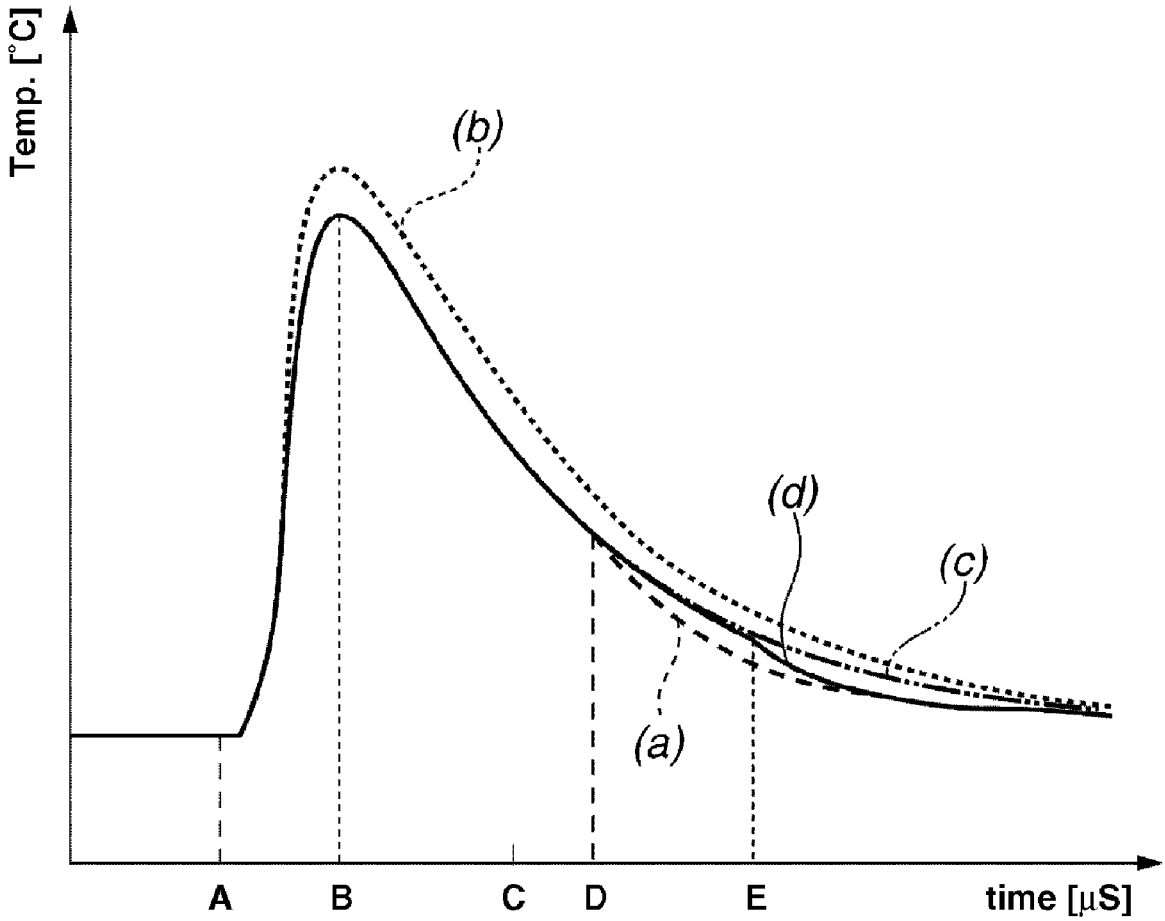
FIG. 1 illustrates example temperature profiles of different discharge states according to an exemplary embodiment of the present invention.

FIG. 1 is a curve chart of time vs. temperature change when a driving pulse is applied to the discharge heater 3 for 0.8 microseconds (μS) for an ink to be discharged from a nozzle. FIG. 1 indicates that the temperature profiles detected by the temperature sensor 5 are different according to the discharge states. Lines (a) to (d) indicate various temperature profiles.

In measuring the temperature, the CPU 400 stores the temperature profile data sequentially into a memory or the RAM 402, for example, in synchronization with a signal from the timer unit. The CPU 400 then processes the data stored in the memory. The CPU 400 performs a process such as differentiation (first-order and second-order differentiation), to be described later, or calculation of the difference in timings.

In FIG. 1, a driving pulse is applied at timing A. This timing A corresponds to the time A in FIG. 6C described above. The maximum temperature is reached at timing B. At timing C, the measurement is started, as will be described later. Timing D is the timing of an inflection point (inflection point 1) when ink is discharged normally. Timing E is the timing of an inflection point (inflection point 2) when the nozzle is clogged by ink to cause ink non-discharge (hereinafter referred to as a wet ink non-discharge state).

Line (a) indicates the case of a normal ink discharge. After a certain period of time from the time when the detected temperature reaches the maximum temperature, a point occurs where the manner of the temperature fall process changes, if the driving condition is constant. In other words, a point occurs where the rate (or slope) at which the temperature falls per unit time changes significantly. Here, the slope of line (a) has a negative value. The absolute value of the negative slope becomes smaller as line (a) reaches timing D. At timing D, the absolute value of the slope is the least. As time elapses, the absolute value of the negative slope becomes greater. As time further elapses, the absolute value of the negative slope becomes smaller again.

The above-described temperature change is caused by the cavitation-resistant film 26 contacting the ink again as described with reference to FIG. 6B. As a result, the nozzle is cooled down at a faster rate. Hereinafter, this point will be referred to as an inflection point 1. In the nozzle configuration in the present exemplary embodiment, the infliction point 1 occurs 4.2 μS after the temperature detected by the temperature sensor 5 reaches the maximum temperature.

On the other hand, in a case where ink is not discharged normally, a change in slope of the temperature fall process does not occur, as indicated by line (b) in FIG. 1. The ink is not discharged because a residual bubble is in contact with the cavitation-resistant film 26. As a result, the heat conducted from the discharge heater 3 does not reach the ink, and a phase change does not take place in the ink. Such a discharge state is referred to as an ink non-discharge state due to bubble.

Furthermore, there is a case where dust clogs the vicinity of a nozzle and the ink is not ejected normally from the nozzle. In such a case, the temperature change detected by the temperature sensor 5 is as indicated by line (c) in FIG. 1. This state is referred to as an ink non-discharge state due to dust. In this case as well, an inflection point does not occur at the same timing as in a normal ink discharge.

Figure 9:
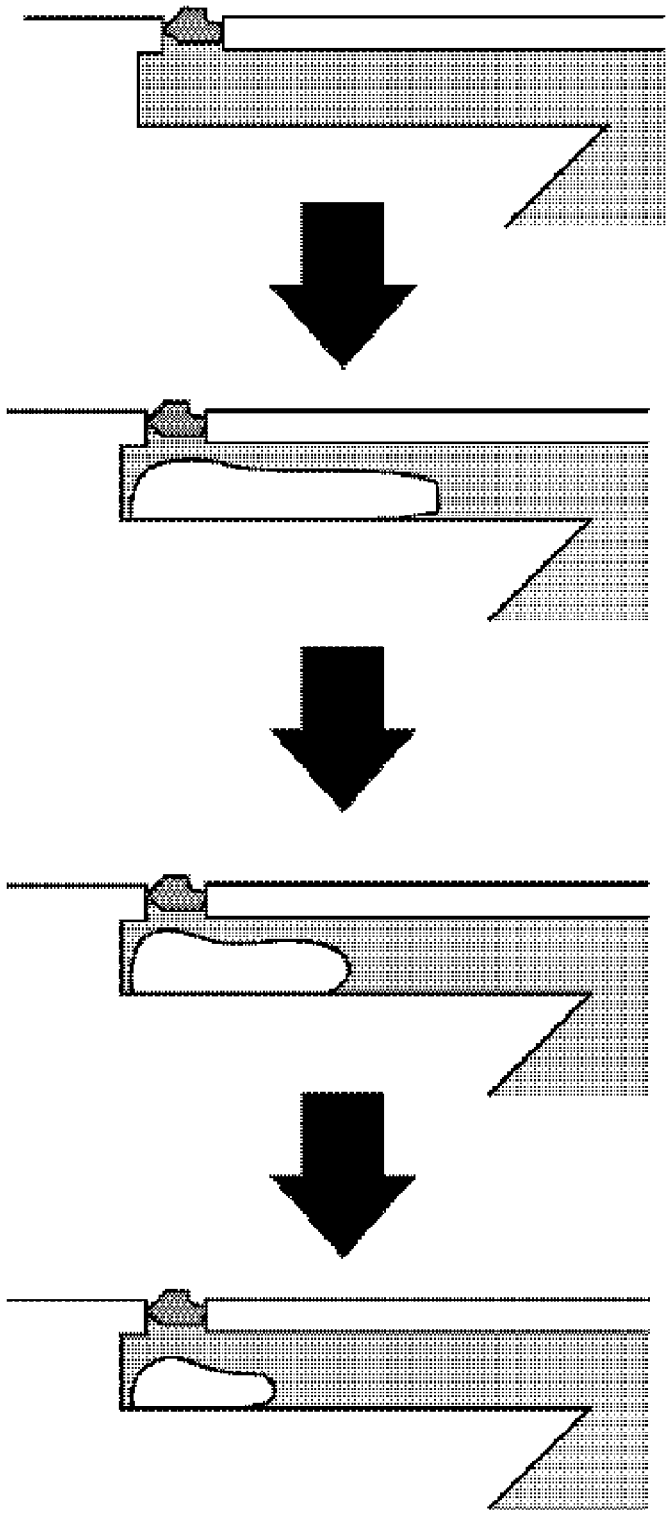
FIG. 9 illustrates the internal state of a nozzle indicated by line (c) in FIG. 1 according to an exemplary embodiment of the present invention.

FIG. 9 illustrates the state inside the nozzle as indicated by line (c). As apparent from FIG. 9, an impurity in the flow path clogs the nozzle, and a normal ink discharge cannot be conducted according to the generation and growth of a bubble. Although a bubble expands and contracts, the bubble expands towards a common liquid chamber because a part of or the entire nozzle is clogged. As a result, the timing of the ink contacting the cavitation-resistant film 26 is delayed greatly as compared to a normal ink discharge. Consequently, a rapid change in the cooling rate does not occur.

In the case of a wet ink non-discharge state as indicated by line (d), a change in slope occurs in the temperature fall process. However, timing E at which the change in slope occurs (hereinafter referred to as an inflection point 2) is later than timing D of inflection point 1.

The inside of the inkjet recording head is maintained at negative pressure, which is slightly lower than atmospheric pressure, so that ink does not leak from the nozzle. For example, a foam material of a porous body is incorporated inside the ink tank which supplies ink. The capillary force from the foam material maintains the negative pressure. Generally, the attached ink clogging the nozzle is suctioned into the inside of the recording head by the negative pressure.

Figure 8:
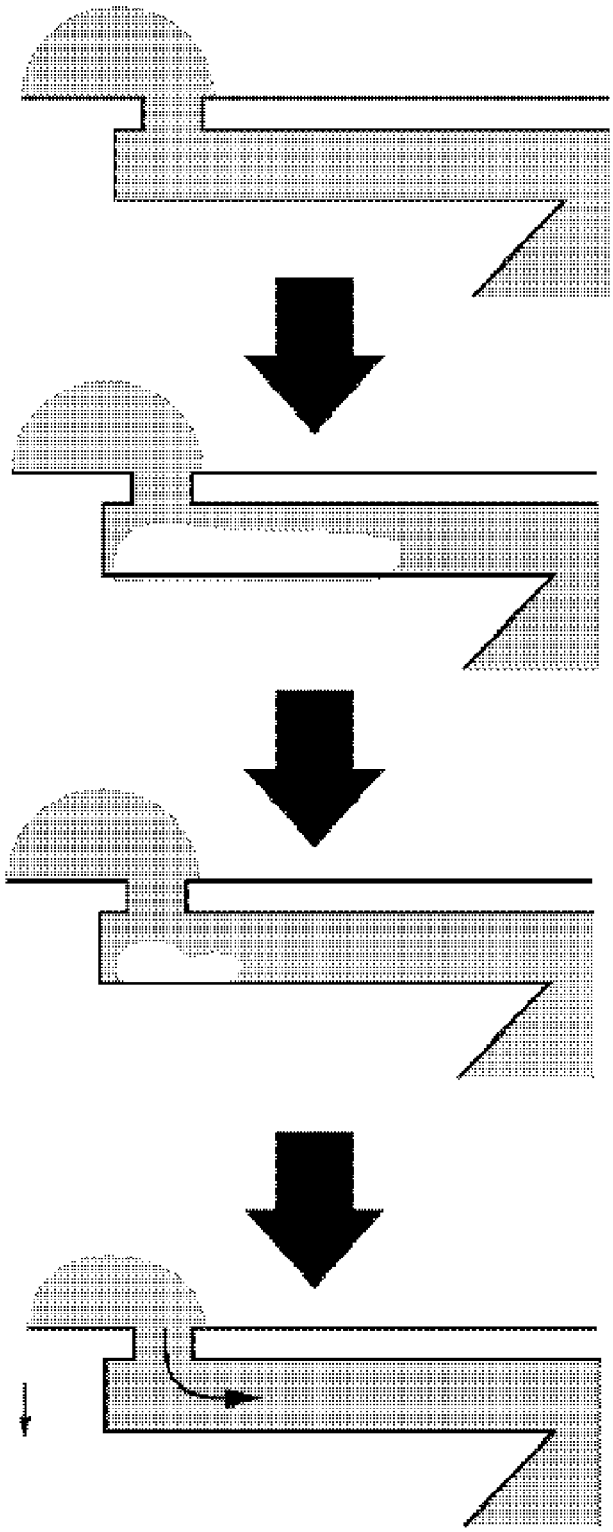
FIG. 8 illustrates the internal state of a nozzle indicated by line (d) in FIG. 1 according to an exemplary embodiment of the present invention.

FIG. 8 illustrates the internal state of the nozzle as indicated by line (d). Since ink is attached to the nozzle surface in such a way as to clog the nozzle, ink cannot be discharged normally according to the generation and growth of a bubble, as in the ink non-discharge state due to dust. Although a bubble expands and contracts, the bubble expands towards the common liquid chamber because the nozzle is clogged.

In addition, the ink suction due to negative pressure described above is suppressed by the bubble while the bubble is expanding and contracting. However, ink suction due to negative pressure starts again when the contraction of the bubble is near the end. The suctioned ink cools down the nozzle and increases the cooling rate so that the slope becomes steep. This inflection point 2 occurs 5.7 μS after the maximum temperature is detected by the temperature sensor 5 in the nozzle configuration of the present exemplary embodiment.

Figure 2A:
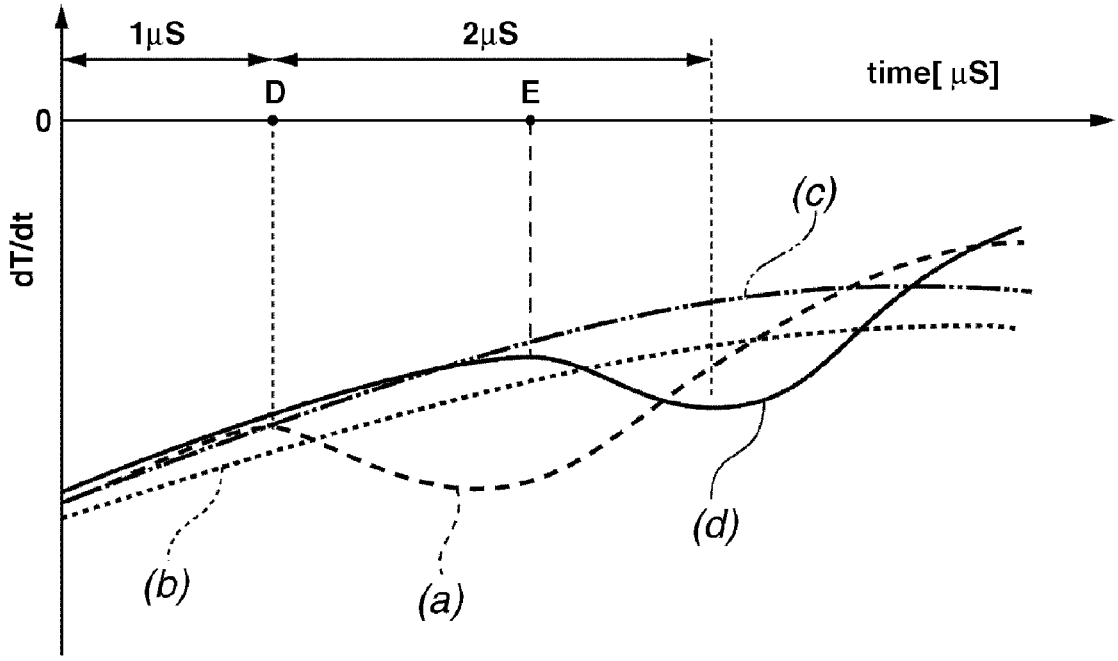
FIGS. 2A and 2B illustrate example calculation results of the first-order differentiation and the second-order differentiation of a temperature change according to an exemplary embodiment of the present invention.

FIG. 2A illustrates a result of a first-order differentiation, with respect to time, of the temperature change in each discharge state detected by the temperature sensor 5. The differentiation is performed between 1 μS before and 4 μS after the timing of the inflection point 1 in a normal discharge state. The timing of 1 μS before the inflection point 1 corresponds to the timing C in FIG. 1.

Referring to FIG. 2A, the results of the first-order differentiation, with respect to time, of the profiles at a normal discharge state and a wet ink non-discharge state have maximum and minimum values. These values appear or occur at timings corresponding to the inflection points. Such values do not occur in the ink non-discharge state due to bubble or dust.

Figure 2B:
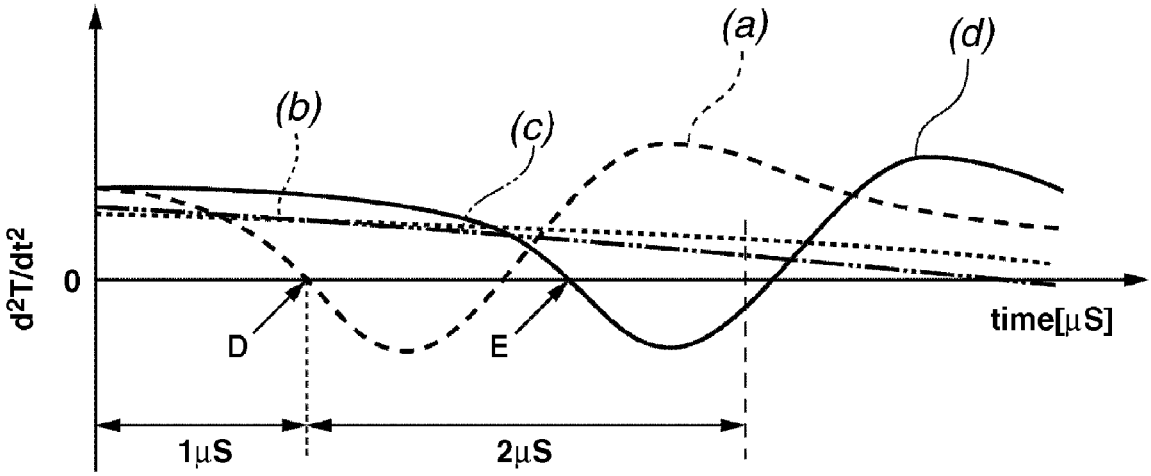

FIG. 2B illustrates a result of a second-order differentiation. That is, the result of the first-order differentiation of the temperature profiles of each discharge state is further differentiated with respect to time. The calculation result of the second-order differentiation switches from a positive value to a negative value at the timing corresponding to an inflection point. In addition, a negative peak appears after the switching points in the normal discharge state and the wet ink non-discharge state.

On the other hand, a negative peak value does not appear in the ink non-discharge states due to bubble or dust. Considering a determination method from a perspective of a discharge abnormality determination system, the difference in the output values of the second-order differentiation waveform of the temperature profile is greater than that of the first-order differentiation waveform. Therefore, a determination method using the second-order differentiation waveform is applied in the present exemplary embodiment to detect discharge abnormality. The first-order differentiation can be used as a different determination method. The inflection point can be detected from a change in the curvature of a temperature profile, or by using pattern matching.

Figure 3:
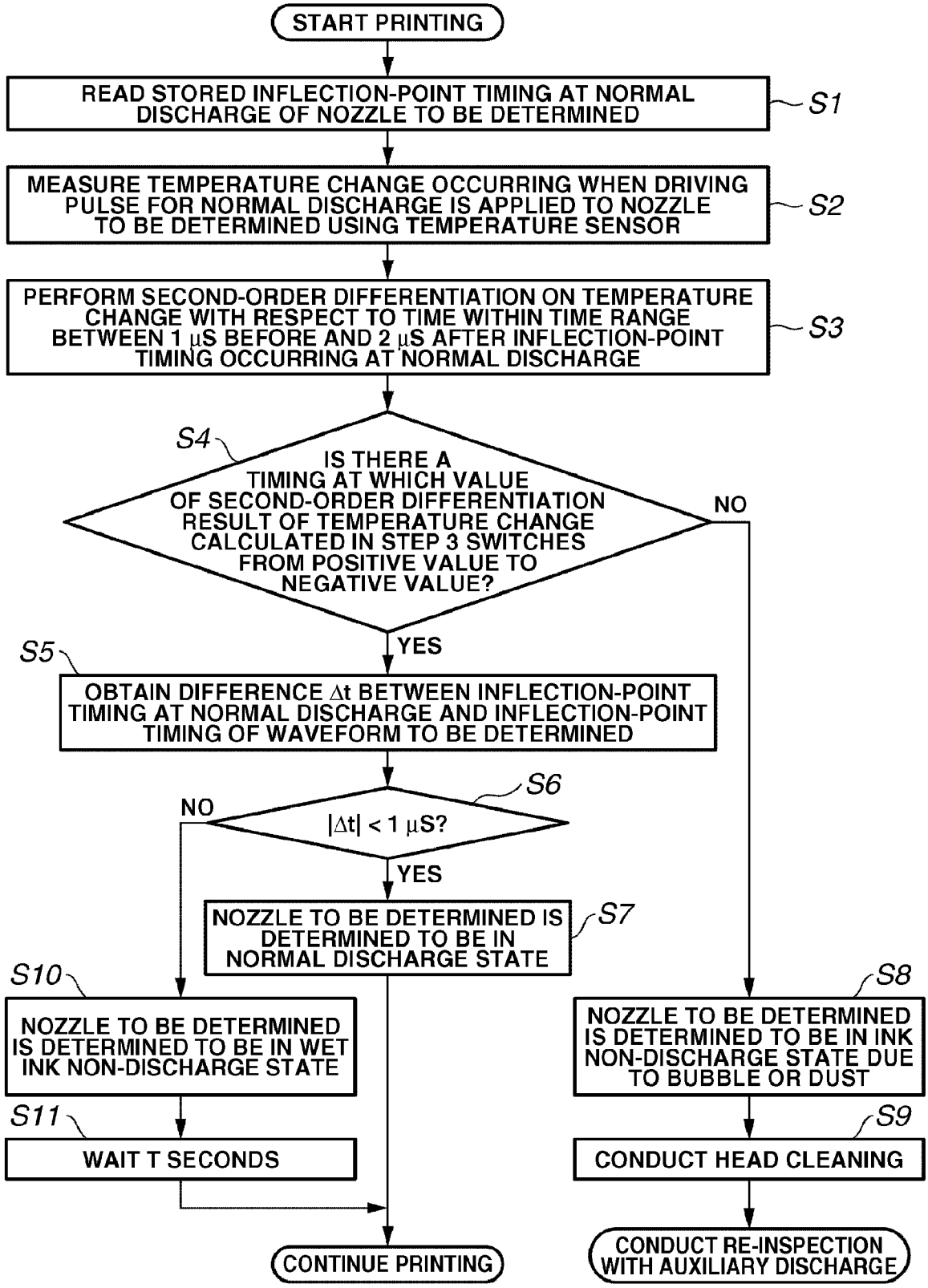
FIG. 3 is an example flowchart for controlling determination of ink discharge according to an exemplary embodiment of the present invention.

FIG. 3 is a flowchart illustrating processing for determining an ink non-discharge of a nozzle according to the present exemplary embodiment. In step S1, the CPU 400 reads the previously stored timing of the inflection point 1 of a nozzle to be determined in a normal discharge state. This timing data is obtained just after conducting head cleaning when a normal discharge is ensured. The timing at which the value of the second-order differentiation of the temperature waveform profile switches from a positive value to a negative value is obtained and stored in a memory.

In step S2, the CPU 400 measures, with the temperature sensor 5, a temperature change caused by applying a driving pulse of a normal discharge to the nozzle to be determined. The applied driving pulse is, for example, of a driving voltage of 20 V and a pulse application time of 0.8 μS.

In step S3, the CPU 400 performs a second-order differentiation of the temperature change measured in step S2 with respect to time. The second-order differentiation is performed between 1 μS before and 2 μS after the inflection point timing in a normal discharge state read in step S1.

In step S4, the CPU 400 determines whether there is a timing at which the value of the second-order differentiation result of the temperature change calculated in step 3 switches from a positive value to a negative value.

If the CPU 400 determines that there is no timing of switching from a positive value to a negative value in step S4 (NO in step S4), the process proceeds to step S8. In step S8, the CPU 400 determines that the nozzle to be determined is in an ink non-discharge state due to bubble or dust. Consequently, in step S9, head cleaning is conducted. Then, an auxiliary discharge is conducted to inspect the nozzle so as to determine whether the head cleaning has resolved the ink non-discharge.

On the other hand, if the CPU 400 determines that there is a timing of switching from a positive value to a negative value in step S4 (YES in step S4), the process proceeds to step S5. In step S5, the CPU 400 obtains a difference Δt between the inflection point timings of a normal discharge state and of the waveform to be determined. That is, the CPU 400 determines whether the nozzle to be determined has performed a normal discharge according to the timing of a normal discharge state.

The inflection timing is determined, for example, based on the elapsed time from the timing C at which the measurement starts as described with reference to FIG. 1. The elapsed time from the start time of the driving pulse (or timing A in FIG. 1) can also be used if time can be measured accurately.

In step S6, the CPU 400 determines whether the absolute value of the difference Δt, or |Δt|, is less than 1 μS. If the CPU 400 determines that the absolute value |Δt| is less than 1 μS (YES in step S6), the process proceeds to step S7. In step S7, the CPU 400 determines that the nozzle to be determined is in a normal discharge state. When the absolute value |Δt| is less than 1 μS, an inflection point occurs within 1 μS before and after the inflection point timing in a normal discharge state. After the CPU 400 determines that the nozzle to be determined is in a normal discharge state in step S7, the CPU 400 continues recording (printing).

If the CPU 400 determines that the absolute value |Δt| is greater than or equal to 1 μS (NO in step S6), the process proceeds to step S10. In step S10, the CPU 400 determines that the nozzle to be determined is in a wet ink non-discharge state. In other words, the CPU 400 determines that an inflection point occurs within a time range from 1 μS to 2 μS after the inflection point timing in a normal discharge state.

After the determination in step S10, the CPU 400 discontinues printing (recording), and the process proceeds to step S11. In step S11, the CPU 400 performs control to wait T seconds so that the wetness is solved. After that, the CPU 400 resumes printing and also resumes the ink non-discharge determination.

The wait time T in step S11 is usually 1 to 10 seconds. The length of the wait time T depends on the water repellency of a discharge port of the recording head or on the ink characteristic such as surface tension. The length of the wait time T can be changed, for example, according to the number of nozzles in which a wet ink non-discharge state has occurred, rather than be defined uniformly.

In the above-described exemplary embodiment, a single pulse is applied as a driving pulse. However, split pulses with more than two successive pulses can be applied in the present exemplary embodiment. When the split pulses are applied, the time between the start of applying pulses and the occurrence of an inflection point becomes longer. Consequently, the time between the reaching of a maximum temperature and the occurrence of an inflection point, or the time between inflection points 1 and 2, can differ depending on the type of a driving pulse to be applied. As a result, the inflection point timing in a normal discharge state or the difference $\Delta t$ becomes different. Therefore, a more accurate determination can be performed by independently setting the time range of the temperature waveform to be determined or the threshold of the difference $\Delta t$.

Furthermore, in the above-described exemplary embodiment, the ink non-discharge is determined by comparing the timings of the inflection points. However, the determination can also be made by comparing the timing of negative peaks of the second-order differentiation waveform.

As described above, when a driving pulse is applied to a nozzle of a recording head during printing, a temperature detected by a temperature detection element is measured. Then, it is determined whether there is ink attached to the nozzle in such a way as to clog the nozzle. As a result, unnecessary head cleaning can be avoided and the throughput performance can be increased.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2006-164710 filed Jun. 14, 2006, which is hereby incorporated by reference herein in its entirety.

What is claimed:

1. A method for inspecting a recording head including a plurality of electrothermal conversion elements and a temperature detection element disposed above or below each of the plurality of electrothermal conversion elements, the method comprising:

driving the electrothermal conversion element;

performing a second-order differentiation based on information on temperature detected by the temperature detection element;

obtaining a timing at which a calculation result of the second-order differentiation changes from a positive value to a negative value;

determining whether there is a change in slope of a temperature fall process in temperature detected by the temperature detection element during a predetermined time based on the timing;

if it is determined that there is a change in slope of the temperature fall process, obtaining a timing of the change in slope; and determining whether ink is discharged normally based on the obtained timing of the change in slope and a predetermined timing of a change in slope of the temperature fall process.

2. The method according to claim 1, further comprising determining whether ink is discharged normally based on a time difference between the obtained timing of the change in slope and a predetermined timing of a change in slope of the temperature fall process.

3. The method according to claim 1, further comprising storing, in a storage unit, information on temperature detected by the temperature detection element after starting driving the electrothermal conversion element.

4. The method according to claim 1, further comprising generating a profile of temperature detected by the temperature detection element after starting driving the electrothermal conversion element.

5. An apparatus for inspecting a recording head including a plurality of electrothermal conversion elements and a temperature detection element disposed above or below each of the plurality of electrothermal conversion elements, the apparatus comprising:

a driving unit configured to drive the electrothermal conversion element;

a first determination unit configured to determine whether there is a change in slope of a temperature fall process in temperature detected by the temperature detection element during a predetermined time, based on a timing;

an obtaining unit configure to, if it is determined that there is a change in slope of the temperature fall process, obtain a timing of the change in slope; and a second determination unit configured to determine whether ink is discharged normally based on the timing of the change in slope obtained by the obtaining unit and a predetermined timing of a change in slope of the temperature fall process, wherein a second-order differentiation is performed based on information on temperature detected by the temperature detection element;

wherein the timing is obtained at which a calculation result of the second-order differentiation changes from a positive value to a negative value.

6. A recording apparatus comprising:

a recording head including a plurality of electrothermal conversion elements and a temperature detection element disposed above or below each of the plurality of electrothermal conversion elements;

a driving unit configured to drive the electrothermal conversion element;

a first determination unit configured to determine whether there is a change in slope of a temperature fall process in temperature detected by the temperature detection element during a predetermined time, based on a timing;

an obtaining unit configured to, if it is determined that there is a change in slope of the temperature fall process, obtain a timing of the change in slope; and a second determination unit configured to determine whether ink is discharged normally based on the timing of the change in slope obtained by the obtaining unit and a predetermined timing of a change in slope of the temperature fall process, wherein a second-order differentiation is performed based on information on temperature detected by the temperature detection element;

wherein the timing is obtained at which a calculation result of the second-order differentiation changes from a positive value to a negative value.

* * * * *